United States Patent [19]

Peter

[11] Patent Number: 5,063,971

[45] Date of Patent: Nov. 12, 1991

[54] CLUTCH ELEMENT FOR A HEALD SHAFT COUPLING

[75] Inventor: Hans Peter, Winterthur, Switzerland

[73] Assignee: Sulzer Brothers Limited, Winterthur, Switzerland

[21] Appl. No.: 543,661

[22] Filed: Jun. 25, 1990

[30] Foreign Application Priority Data

Jul. 7, 1989 [CH] Switzerland ..... 02545/90

[51] Int. Cl.[5] ..... D03C 13/00

[52] U.S. Cl. ..... 139/87; 192/43.1; 403/341

[58] Field of Search ..... 403/341; 192/47, 56 L, 192/43.1; 139/87, 88, 82

[56] References Cited

U.S. PATENT DOCUMENTS 2,867,144 1/1959 Stevens ..... 192/56 L 4,336,728 6/1982 Deibert ..... 192/43.1

4,541,459 9/1985 Palau ..... 139/88

4,770,213 9/1988 Peter ..... 139/88

*Primary Examiner*—Andrew M. Falik

*Attorney, Agent, or Firm*—Kenyon & Kenyon

[57] ABSTRACT

The clutch element for coupling and uncoupling the coupling elements of the shaft coupling arrangement is rotatably mounted on one coupling element and is rotated by an actuating tool external to the clutch element. The tool includes a drive shaft, crank webs which extend transversely of the drive shaft and a pair of rollers which are disposed externally of the coupling elements. The clutch element includes a pair of wedges sandwiched between two circular segment plates and pivotally mounted on a projection of a push rod. The wedges engage in pockets on the exterior of the coupling elements.

10 Claims, 5 Drawing Sheets

CLUTCH ELEMENT FOR A HEALD SHAFT COUPLING

This invention relates to a clutch element for a coupling arrangement for a heald shaft. More particularly, this invention relates to a method of coupling heald shafts to push rods in a loom.

Heretofore, various types of techniques have been known for the coupling of heald shafts with a shaft drive in a loom. For example, German OS 3006363 describes a method wherein two clutch elements on a coupling element of a shaft drive can be pressed apart from one another by an eccentric when a heald shaft coupling member is required to be introduced between the two clutch elements. After the shaft-side coupling member has been introduced into the drive-side coupling member, the eccentric disengages from the clutch elements so that the clutch elements can engage by way of projections in corresponding recesses in the shaft-side coupling members. Embodiments are also described which employ a single clutch element. However, a disadvantage of such a coupling arrangement is that the drive-side coupling member must be very bulky since there must be space in the interior for the clutch element, the eccentric and the shaft-side coupling member. This is contrary to recent loom developments which strive to achieve very reduced moving masses for the purpose of increasing operating speeds.

Accordingly, it is an object of the invention to provide a method of coupling heald shafts such that the shaft can be moved vertically into a drive-side coupling member.

It is another object of the invention to provide coupling elements of very reduced mass for heald shafts.

It is another object of the invention to provide a coupling arrangement for a heald shaft which is of compact construction and of limited weight.

Briefly, the invention provides a coupling arrangement for a heald shaft which is comprised of a first coupling member for securement to a heald shaft and which has at least one external bearing surface, a second coupling element for mounting on a push rod and having at least one external bearing surface and a clutch element pivotally mounted on the second coupling element about a pivot axis spaced from the bearing surfaces. The clutch element also has engagement surfaces spaced from the pivot axis for matingly engaging the bearing surfaces of the two coupling elements. In addition, a pivotally mounted tool is provided for rotating the clutch element about the pivot axis in order to couple the coupling elements to each other. For uncoupling purposes, the clutch element is rotated in the opposite direction.

The invention also provides a method in which a clutch element positioned between the coupling elements are rotated in one direction to engage the engagement surfaces thereof with the external bearing surfaces of the coupling elements while being rotated in an opposite direction to uncouple the coupling elements.

These and other objects and advantages of the invention will become more apparent from the following detailed description taken in conjunction with the accompanying drawings wherein.

Figure 3:
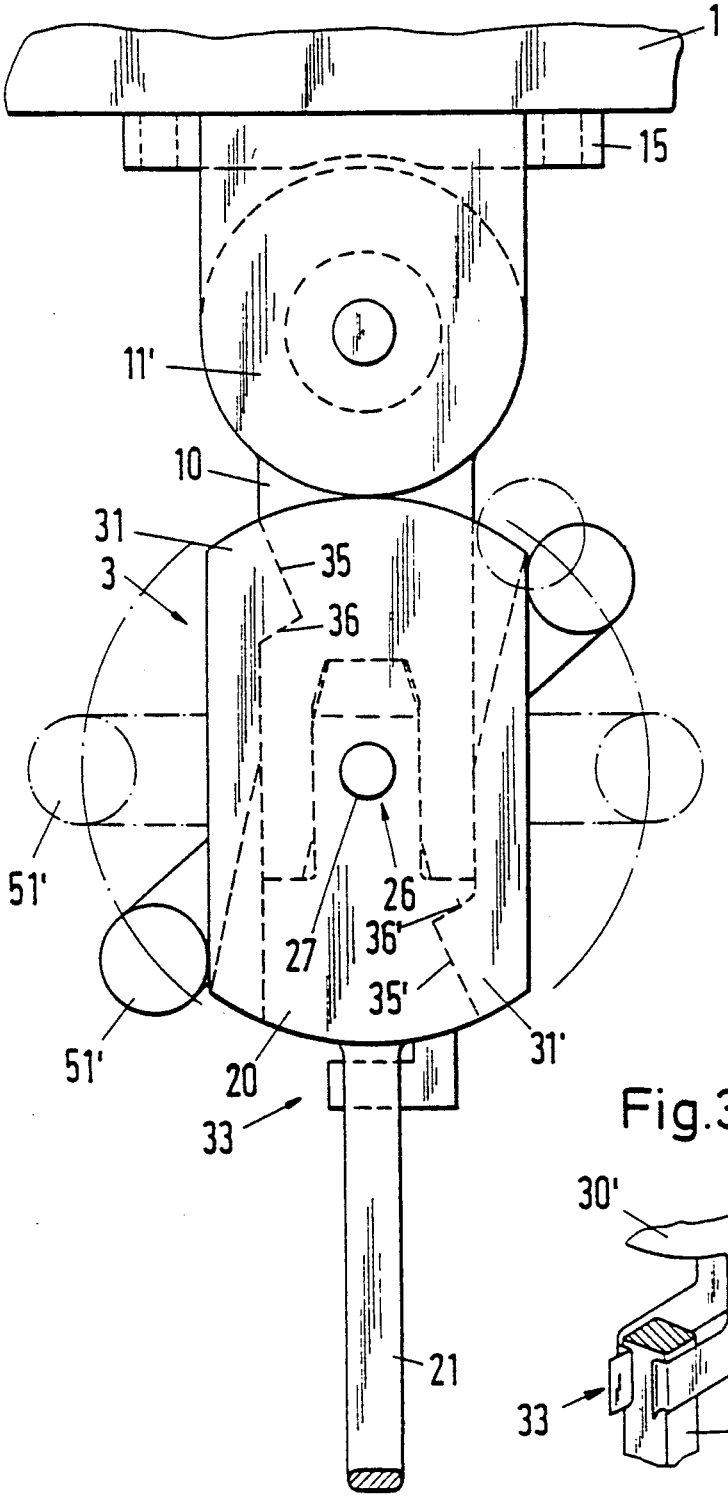
FIG. 3 illustrates a side view of the coupling arrangement in a coupled position.
Figure 3B:
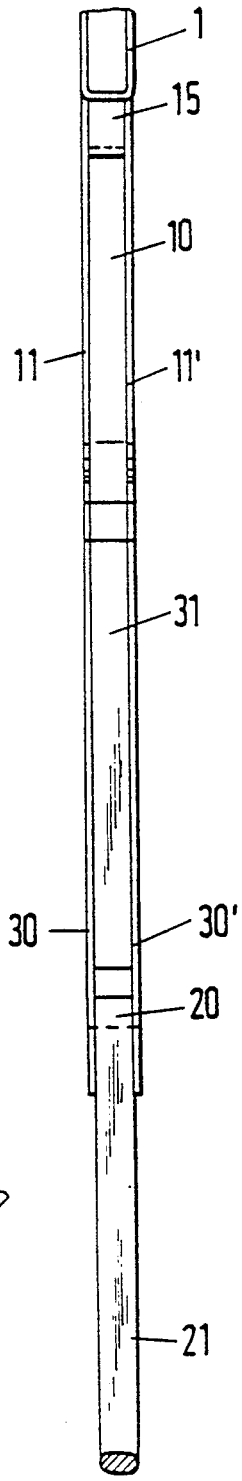
Figure 3A:
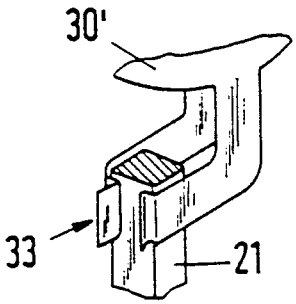
Figure 4:
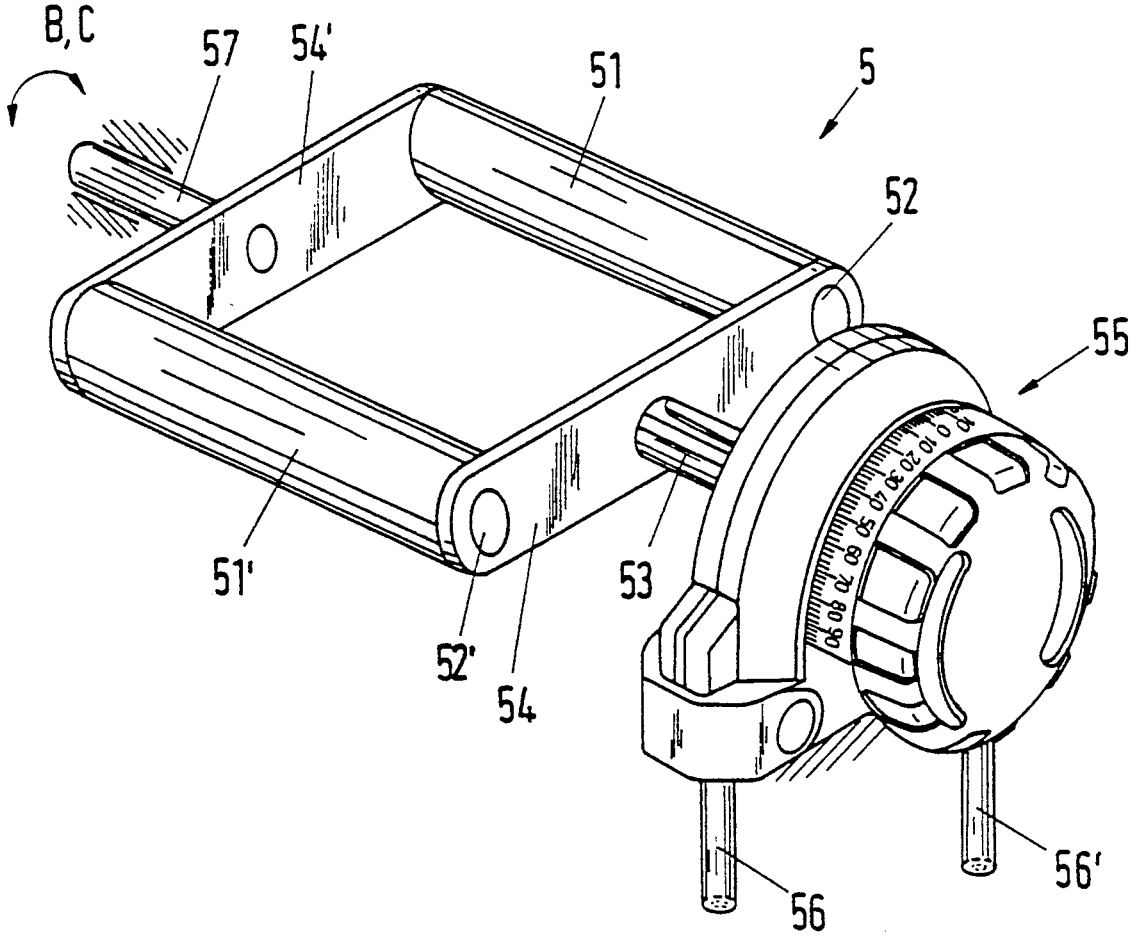
Figure 5:
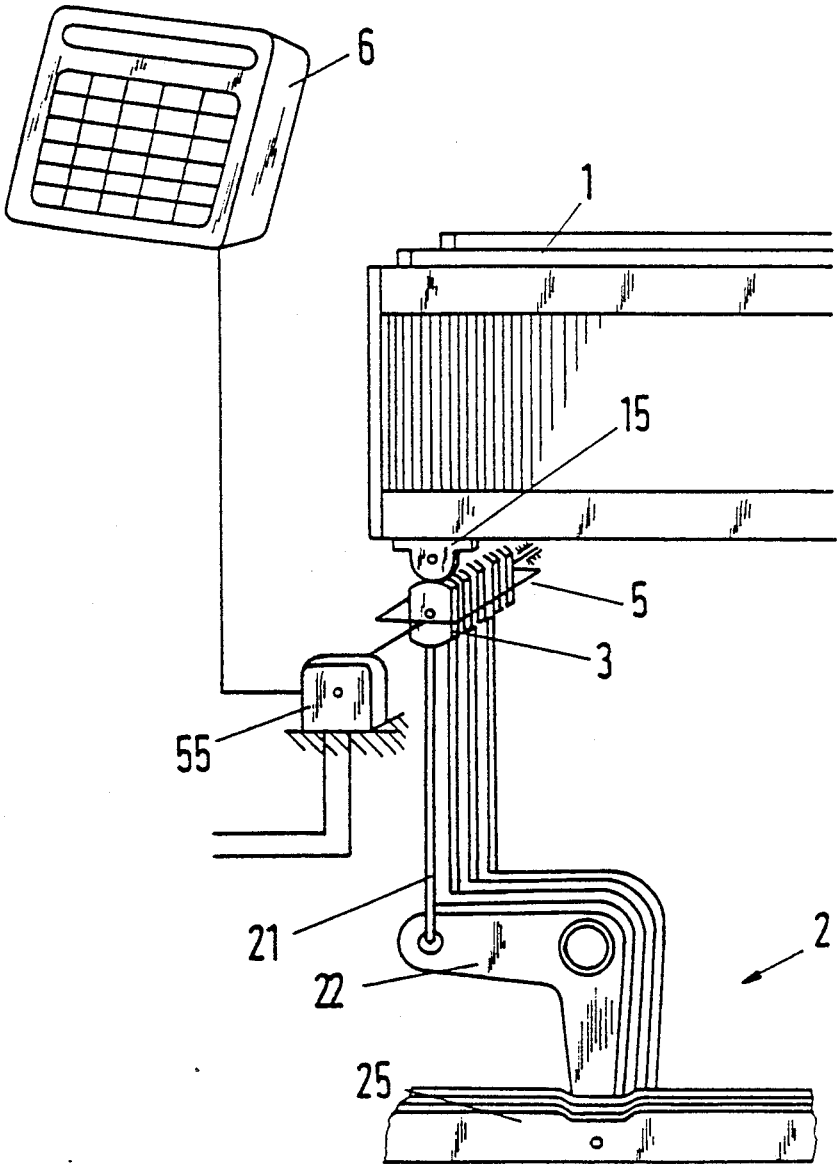

FIG. 3*a* illustrates a detailed view of a locking means for securing the coupling elements in coupled relation;

FIG. 3*b* illustrates a side view of the coupling arrangement of FIG. 3;

FIG. 4 illustrates a perspective view of an actuating tool and a pneumatic actuation motor connected to the tool in accordance with the invention; and FIG. 5 diagrammatically illustrates an actuating system for actuating a coupling arrangement in accordance with the invention.

Figure 1:
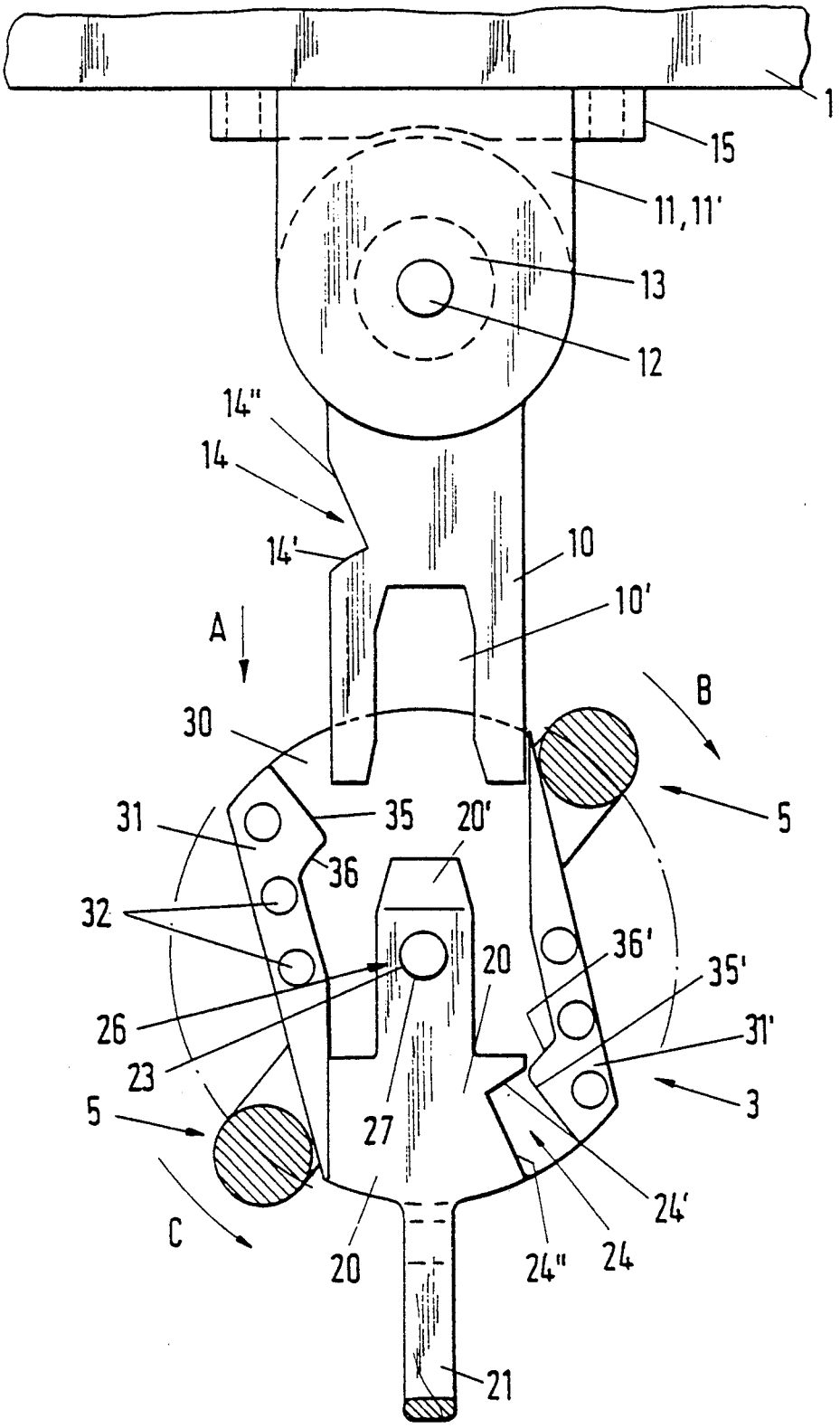
FIG. 1 illustrates a part sectional view of a coupling constructed in accordance with the invention prior to coupling.
Figure 2:
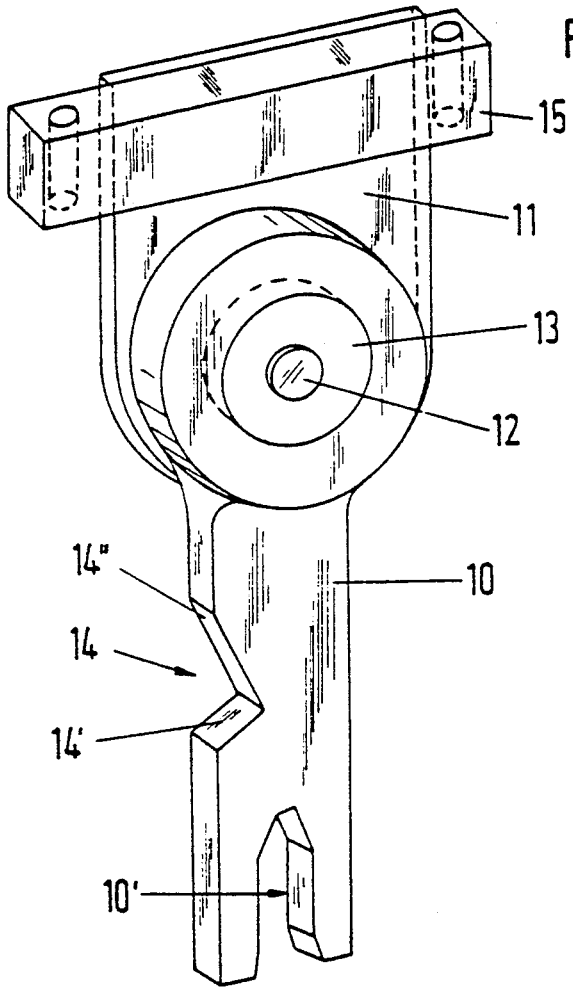
FIG. 2 illustrates an exploded view of the coupling elements of a coupling arrangement in accordance with the invention.
Figure 2:
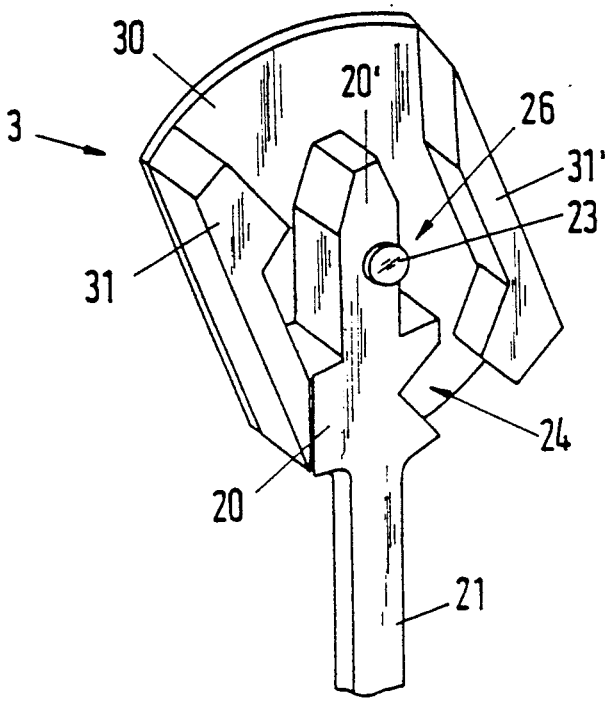

Referring to FIGS. 1 and 2, each coupling arrangement employs a coupling element 10 which is mounted on the bottom of a heald shaft 1 of a loom by means of a suitable support. As indicated, the support includes a carrier 15 which can be secured to the bottom of the heald shaft 1, for example by means of bolts (not shown), a pair of depending lugs 11, 11' which depend from the carrier 15, a pin 12 which is secured between the lugs 11, 11' and a spacer 13 which is mounted concentrically of the pin 12 and which rotatably supports the coupling element 10 thereof. The coupling element 10 also has a recess 10' formed between two rigid arms and a pocket 14 in the external surface which defines a pair of bearing surfaces 14', 14''. This coupling element 10 can be moved vertically with the shaft 1, for example in the direction indicated by the arrow A.

The coupling arrangement also includes a second coupling element 20 which is mounted on a push rod 21 below the coupling element 10. This coupling element 20 includes a projection 20' which is sized to fit into the recess 10' of the coupling element 10. In addition, the coupling element 20 is provided with a pocket 24 in an external surface to define a of bearing surfaces 24', 24''.

The coupling arrangement also includes a clutch element 3 includes a pair of segmented circular cover plates 30, 30', and a pair of wedges 31, 31' which are secured to and between the plates 30, 30', for example by projection welding at joins 32. Of note, FIG. 2 illustrates the clutch element 3 with only the back cover plate visible. Also, as indicated, each plate 30, 30' is circular with segments being cut off outside the wedges 31, 31'.

A pin 23 is received in a bore in the projection 20' of the mounting part 20 at the upper end of the push rod 21 and acts as a bearing point 26 for the plates 30, 30' of the clutch element 3. In this respect, each plate 30, 30' is provided with a central bore which is effective as a bearing surface 27 on the pin 23. In this way, the clutch element 3 is pivotally mounted on the push rod projection 20.

In addition, each respective wedge 31, 31' is shaped for mating engagement in the respective pockets 14, 24 of the coupling elements 10, 20. As illustrated, each wedge has a pair of bearing surfaces 35, 36; 35', 36'' for abutting against the respective surfaces 14'', 14', 24', 24'', of the pockets 14, 24.

Referring to FIGS. 1 and 4, the coupling arrangement also includes an actuating tool 5 for closing and opening the coupling elements 10, 20 relative to each other. As indicated in FIG. 4, the tool 5 includes a drive shaft 53 which is pivotally mounted on a pivot axis, a crank web 54 which is secured to the drive shaft 53 and a pair of diametrically offset members (shown in solid line in FIG. 1) exterior to the clutch element 3. As indicated in FIG. 4, each offset member is formed by a spindle 52, 52' which is secured to the end of the crank web 54 and a roller 51, 51' which is mounted on a respective spindle for abutting and moving the clutch element 3 upon pivoting of the drive shaft 53.

The tool 5 also has a second shaft 57 coaxial of the drive shaft 53 and a second crank web 54' secured at opposite ends to the spindles 52, 52' so as to form a frame.

As illustrated in FIG. 4, a pneumatic actuation motor 55 is connected to the drive shaft 53 for pivoting the shaft 53 about the pivot axis in the directions indicated by the arrows B, C. The motor 55 is also provided with suitable lines 56, 56' for the supply of compressed air depending up the direction of pivoting desired. A dial is also provided to indicate the angular position of the drive shaft 53 and/or the degree of pivoting of the drive shaft 53 and thus the tool 5.

Referring to FIG. 1, in order to effect a coupling, the tool 5 is rotated in the direction indicated by the arrow C so as to engage the wedges 31, 31' and to rotate the coupling element 3 in a counter clockwise manner, as viewed, for example until the trailing tapered end of the wedge 31 abuts against a flat side wall of the coupling element 20 on the push rod 21. In the illustrated position, the coupling element 10 is able to receive the projection 20' within the recess 10'. Next, the shaft 1 is moved downwardly so that the coupling element 10 receives the projection 20' in the recess 10' (see FIG. 3). The tool 5 is then rotated in a clockwise direction as indicated by the arrow B in FIG. 1 so that the entire clutch element 3 is rotated with the wedges 31, 31', into mating engagement with the respective pockets 14, 24 of the coupling elements 10, 20.

After coupling is effected, the push rod 21 is able to transmit a vertical movement, for example, from a shaft drive to the shaft 1.

Referring to FIGS. 3, 3*a* and 3*b*, wherein like reference characters indicate like parts as above, a locking means 33 in the form of a snap coupling is provided for securing the coupling elements 10, 20 in coupled relation. As illustrated in FIG. 3*a*, the snap coupling 33 is mounted on the rotatable clutch element 3 to engage over the push rod 21 in the coupled position.

As illustrated in FIG. 3*b*, the coupling arrangement is very slender. Thus, a plurality of shafts, for example twenty shafts may be disposed one beside the other in a loom.

Referring to FIG. 3, the tool 5 can be rotated into a position such that the cylinders 51, 51' are disposed in a common horizontal plane in an operative position of the tool, for example during operation of the loom. In order to effect uncoupling, the cylinders 51, 51' are rotated into the position shown in solid line in order to begin the uncoupling movement.

Referring to FIG. 5, wherein like reference characters indicate like parts as above, after the shafts 1 have been introduced into the loom by a lifter (not shown), for example, at the change of an article in the loom, the loom operator may instruct a control unit 6 to couple the shafts 1 to the push rods 21 so that a shedding operation may begin. To this end, the control unit 6 is able to deliver a suitable signal to the motor 55 so as to pivot the actuating tool 5 into the closed position thereby effecting coupling of the shafts 1 onto the push rods 21. Thus, all of the shafts 1 which are introduced are coupled to the push rods 21. As indicated, a shaft drive 2 is provided for moving the push rods 21. This drive includes a plurality of thrust rods 25 which pivot bent levers 22 which are, in turn, connected to the push rods 21. The thrust rods 25 are actuated by a suitable shedding motion (not shown) of the loom.

As can be gathered from FIG. 3, pulling forces (tension) in the push rod 21 are transmitted via the bearing surfaces 36, 36' on the coupling elements 10, 20 while pushing forces (compressions) are transmitted through the projection 20' within the recess 10'.

The invention thus provides a coupling arrangement of relatively simple compact construction and furthermore provides a clutch element which does not require removal from a loom after actuation and which is of slender lightweight construction.

What is claimed is:

1. A coupling arrangement for a heald shaft comprising a first coupling element for securement to a heald shaft, said element having at least one external bearing surface;

a second coupling element for mounting on a push rod and having at least one external bearing surface;

a clutch element pivotally mounted on said second coupling element about a pivot axis spaced from said bearing surfaces, said clutch element having engagement surfaces spaced from said pivot axis for matingly engaging said bearing surfaces of said coupling elements; and a pivotally -mounted tool for rotating said clutch element about said pivot axis to couple said coupling elements to each other.

2. A coupling arrangement as set forth in claim 1 wherein said clutch element includes a pair of parallel plates pivotally mounted on said second coupling element and a pair of wedges secured to and between said plates, each said wedge having at least one of said engagement surfaces thereon for mating with a respective coupling element.

3. A coupling arrangement as set forth in claim 1 wherein said first coupling element has a recess and said second coupling element has a projection for fitting into said recess.

4. A coupling arrangement as set forth in claim 1 wherein each coupling element has a pocket in an external surface to define said bearing surfaces thereof and said engagement surfaces of said clutch element are internally disposed therein.

5. A coupling arrangement as set forth in claim 1 wherein said coupling elements are disposed for fitting one within the other and said clutch element is disposed externally of said coupling elements.

6. In a loom, the combination comprising at least one shaft;

a first coupling element secured to said shaft and including a pocket in an exterior surface;

a push rod for moving said shaft;

a second coupling element mounted on said push rod and including a pocket in an exterior surface; and a clutch element pivotally mounted on said second coupling element on a pivot axis and having a pair of oppositely disposed wedges spaced from said pivot axis for mating engagement in said pockets upon rotation of said clutch element into engagement with said coupling elements.

7. The combination as set forth in claim 6 which further comprises a pivotally mounted tool for rotating said clutch element about said pivot axis to couple said coupling elements to each other.

8. The combination as set forth in claim 6 wherein said clutch element includes a pair of plates having said wedges secured therebetween and which further comprises a pin secured to said second coupling element on said pivot axis with said plates rotatably mounted thereon.

9. The combination as set forth in claim 6 wherein said clutch element includes a pair of segmented circular plates secured to said wedges and a pin secured to said plates and mounted in said second coupling element on said pivot axis.

10. A method of coupling heald shafts to push rods comprising the steps of providing a first coupling element on a heald shaft with an external bearing surface;

providing a second coupling element on a push rod with an external bearing surface;

positioning a rotatable clutch element having internal engagement surfaces thereon between the coupling elements; and rotating the clutch element in one direction to engage the engagement surfaces thereof with the external bearing surfaces of the coupling elements for coupling thereof and in an opposite direction to uncouple the coupling elements.

* * * * *